US006370742B1

(12) United States Patent
Yamaguchi et al.

(10) Patent No.: US 6,370,742 B1
(45) Date of Patent: Apr. 16, 2002

(54) BUCKLE WITH MOVEMENT PREVENTION DEVICE

(75) Inventors: Yutaka Yamaguchi; Akihiro Shiota; Yoshihiko Kawai; Tadayuki Asako; Takaaki Kimura, all of Tokyo (JP)

(73) Assignee: Takata Corporation, Tokyo (JP)

( * ) Notice: Subject to any disclaimer, the term of this patent is extended or adjusted under 35 U.S.C. 154(b) by 58 days.

(21) Appl. No.: 09/642,468

(22) Filed: Aug. 21, 2000

(30) Foreign Application Priority Data

Aug. 26, 1999 (JP) ..... 11-239645

(51) Int. Cl.[7] ..... A44B 11/26
(52) U.S. Cl. ..... 24/641; 24/633
(58) Field of Search ..... 24/633, 637, 638, 24/641; 297/468

(56) References Cited

U.S. PATENT DOCUMENTS

| | | | | |
|---|---|---|---|---|
| 4,451,958 A | | 6/1984 | Robben et al. |
| 5,008,989 A | * | 4/1991 | Wedler et al. |
| 5,542,162 A | * | 8/1996 | Biller |
| 5,595,400 A | * | 1/1997 | Wier |
| 5,915,633 A | * | 6/1999 | Biller |
| 6,170,134 B1 | * | 1/2001 | Downie et al. |

FOREIGN PATENT DOCUMENTS

| | | |
|---|---|---|
| DE | 38 42 453 | 6/1990 |
| DE | 40 21 974 | 1/1992 |
| EP | 0 402 839 | 12/1990 |
| GB | 2314879 A * | 1/1998 |

* cited by examiner

*Primary Examiner*—James R. Brittain
(74) *Attorney, Agent, or Firm*—Kanesaka & Takeuchi

(57) ABSTRACT

In a latched state of a buckle in which a tongue is engaged, an inertia lever member of a movement preventing device enters into a path of a lock pin. When the buckle is pulled by a buckle pretensioner in this state, the inertia lever member moves in the longitudinal direction, and pressed portions of the inertia lever member are held by a holding portion, so that the inertia lever member does not pivot and the levers are thus held in the path of the lock pin. At the end of pretensioning, the buckle is stopped. Since the moment produced by the inertia force acting on the center of gravity of mass body of the movement preventing device is larger than the moment produced by the inertia force of an operational button, the inertia lever member does not pivot, so that the inertia lever member can be held in the path of the lock pin. In the buckle, the inertia release can be effectively prevented with a simple structure.

4 Claims, 5 Drawing Sheets

BUCKLE WITH MOVEMENT PREVENTION DEVICE

BACKGROUND OF THE INVENTION AND RELATED ART STATEMENT

The present invention pertains to a buckle used in a seat belt device provided for a seat of a vehicle, such as an automobile.

Currently, in various vehicles including automobiles, seat belt devices for protecting occupants in emergency, such as collision, are installed on seats thereof. In order to facilitate the occupant to wear on and off such a seat belt, a buckle is normally provided. In general, the buckle comprises a latch member provided with a joggle portion which engages a tongue, wherein the latch member is biased by a spring in such a direction as to engage the tongue.

In this case, when the spring force against the latch member is set to be weak in order to reduce the operating force for releasing the engagement between the tongue and the buckle, the force for keeping the engagement between the tongue and the latch member is weak. On the other hand, when the spring force against the latch member is set to be strong in order to increase the force for keeping the engagement between the tongue and the latch member, the operating force required for releasing the engagement is increased.

Therefore, the buckle is provided with a lock member which prevents the displacement of the latch member during the engagement with the tongue, thereby minimizing the spring force against the latch member and thus reducing the operating force for releasing the engagement. This technique has been used conventionally.

On the other hand, various seat belt devices having buckle pretensioners connected to the buckles have been proposed. The buckle pretensioner is actuated in case of emergency, such as a vehicle collision, to rapidly pull the buckle so that the seat belt device can quickly restrain a vehicle occupant.

Various seat belt devices having the buckles with the lock members and the buckle pretensioners also have been proposed.

By the way, in such a seat belt device including the buckle with the lock member and the buckle pretensioner, there is a possibility that an unexpected release due to inertia, so-called "inertia release" arises because, when the buckle is suddenly stopped at the end of pretensioning by the buckle pretensioner, due to large inertia, an operational button and the lock member will continue to move toward their release positions where the engagement between the tongue and the buckle is released. Therefore, to prevent such inertia release, the seat belt device is provided with movement prevention means for preventing such movement of the operational button and the lock member toward their release positions.

However, such movement prevention means used in the buckle of the conventional seat belt device has problems that its structure is complex and that its operation is not reliable.

The present invention has been made for solving the above problems and an object of the present invention is to provide a buckle which can effectively prevent the inertia release with improved reliability of operation.

Another object of the invention is to provide a buckle as stated above, wherein the structure is simple.

SUMMARY OF THE INVENTION

To solve the aforementioned problems, the present invention provides a buckle comprising: a base having side walls; a latch member which is supported by the side walls such that the latch member can pivot between an unlatched position and a latched position, and when a tongue is inserted to a predetermined position, the latch member pivots to the latched position to engage the tongue; an operational member for releasing an engagement between the tongue and the latch member; a lock member which is movable between an unlocked position and a locked position, is set in the locked position to hold the latch member in the latched position when the tongue is engaged by the latch member, and is moved by the operational member into the unlocked position to allow the engagement between the tongue and the latch member to be released; and movement prevention means for preventing the operational member and the lock member from moving into such position as to allow the engagement between the tongue and the latch member to be released when the operational member and the lock member are subjected to large inertia force.

The movement prevention means is disposed between the side walls in such a manner that the movement prevention means is movable in the longitudinal direction of the buckle and pivotable, and comprises a mass body, in which the center of gravity is arranged eccentrically relative to the pivot shaft of the movement prevention means, and a lever for preventing the look member from moving into the unlocked position. The lever is out of the path of movement of the lock member when the lock member is set in the unlocked position, and is in the path of movement of the lock member when the lock member is set in the locked position. When inertia force is exerted in a direction opposite to a direction of releasing the engagement between the tongue and the latch member, the movement prevention means moves in the longitudinal direction so as to prevent the pivotal movement of the movement prevention means due to the inertia force acting on the center of gravity of the mass body. When inertia force is exerted in the direction of releasing the engagement between the tongue and the latch member, a moment acting on the movement prevention means in a direction of holding the lever in the path of movement of the lock member is produced by the inertia force acting on the center of gravity of the mass body and a moment acting on the movement prevention means in a direction moving the lever to come off the path of movement of the lock member is produced by the inertia force of the operational member. The mass body is designed in such a manner that the moment produced by the inertia force acting on the center of gravity of the mass body is larger than the moment produced by the inertia force of the operational member.

In the buckle according to the present invention structured as mentioned above, when the buckle is pulled by a buckle pretensioner, inertia force acts on the center of gravity of the mass body, whereby the movement prevention means is prevented from pivoting in a direction of moving the lever to come off the path of movement of the lock member. Since the mass body is designed in such a manner that the moment produced by the inertia force acting on the center of gravity of the mass body is larger than the moment produced by the inertia force of the operational member, these moments being produced at the end of pretensioning travel by the buckle pretensioner when the buckle is suddenly stopped, the movement prevention means is prevented from pivoting in a direction moving the lever to come off the path of movement of the lock member. In this manner, the inertia release can be securely prevented.

In this case, the movement prevention means is composed of only the mass body and the lever, thereby simplifying the structure thereof.

DETAILED DESCRIPTION OF PREFERRED EMBODIMENTS

Hereinafter, embodiments of the present invention will be described with reference to the accompanying drawings.

Figure 1:
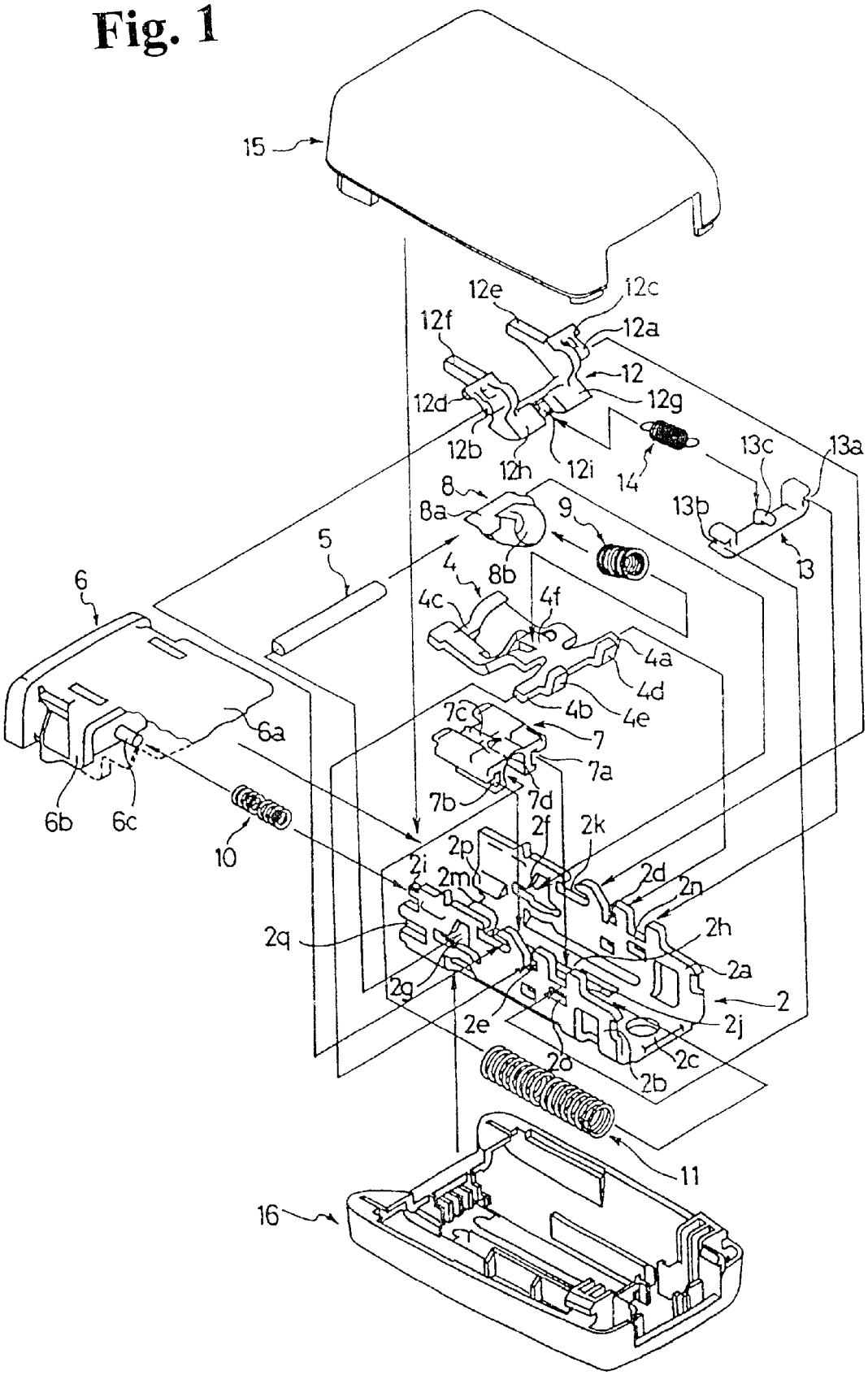
FIG. 1 is an exploded perspective view showing an embodiment of a buckle of the present invention.
Figure 2:
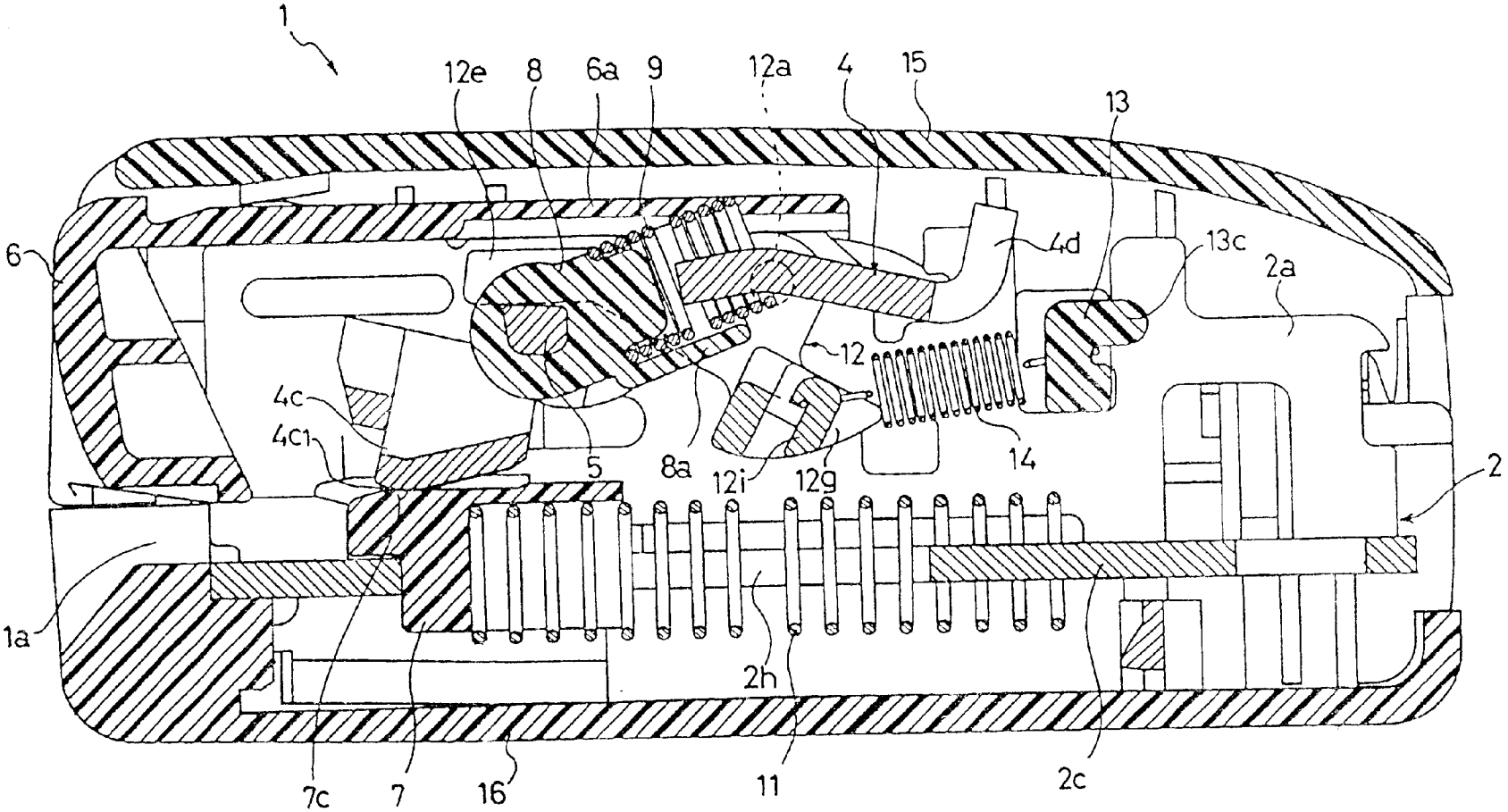
FIG. 2 is a sectional view showing the buckle of this embodiment in an unlatched state in which a tongue is not engaged.
Figure 3:
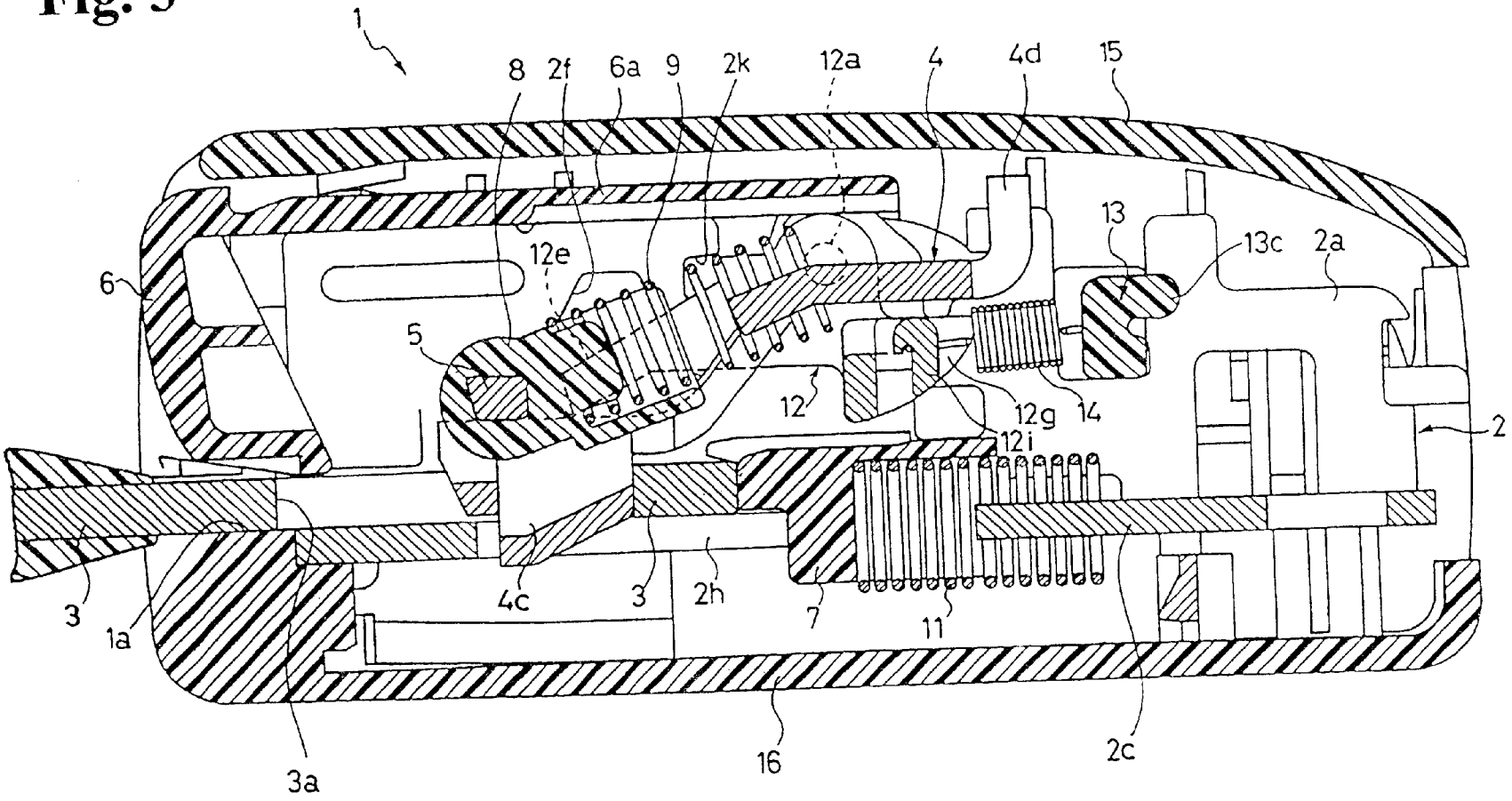
FIG. 3 is a sectional view showing the buckle of this embodiment in a latched state in which the tongue is engaged.
Figure 4:
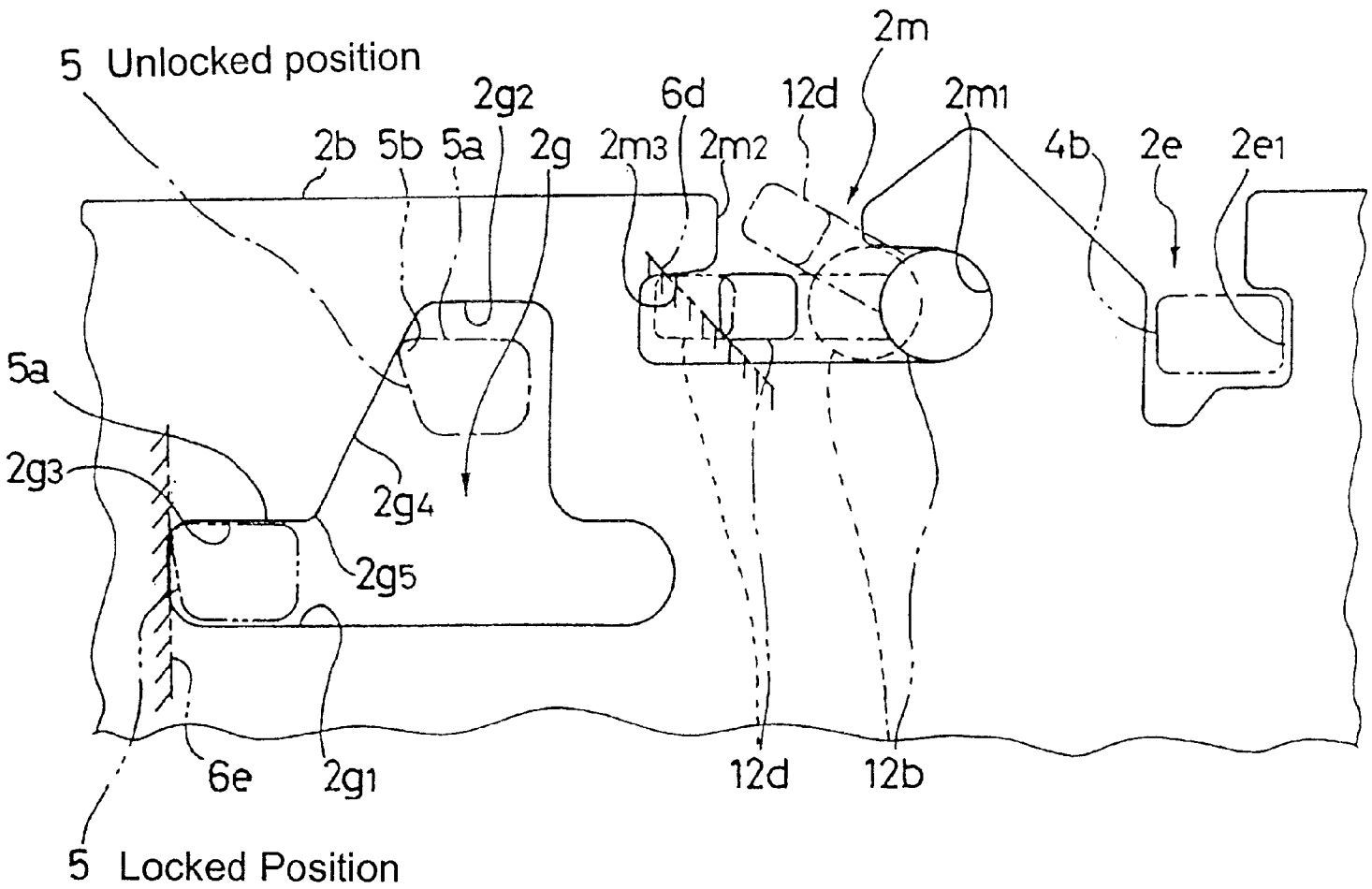
FIG. 4 is a view showing a guide hole, a supporting groove, and a guide groove formed in a side wall of a base of the buckle of this embodiment.
Figure 5A:
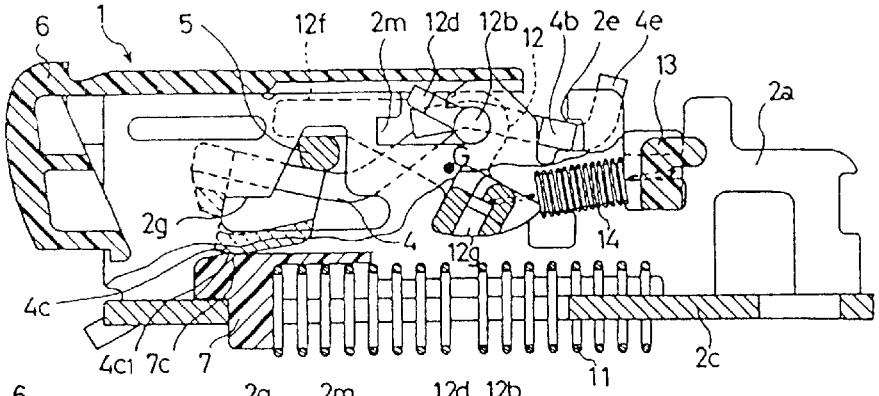
FIGS. 5(*a*)–5(*d*) are views for explaining the action of the buckle of the embodiment for engaging the tongue and the action for preventing the inertia release while the buckle and the tongue are engaged, wherein FIG. 5(*a*) is a view showing the unlatched state in which the tongue is not engaged with the buckle, FIG. 5(*b*) is a view showing the latched state in which the tongue is engaged with the buckle, FIG. 5(*c*) is a view showing the state when the buckle is pulled by the buckle pretensioner, and FIG. 5(*d*) is a view showing the state when the buckle is suddenly stopped at the end of pretensioning movement by the buckle pretensioner.
Figure 5B:
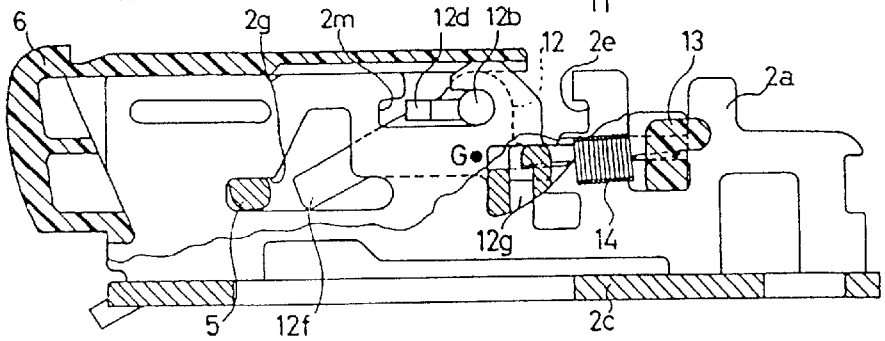
Figure 5C:
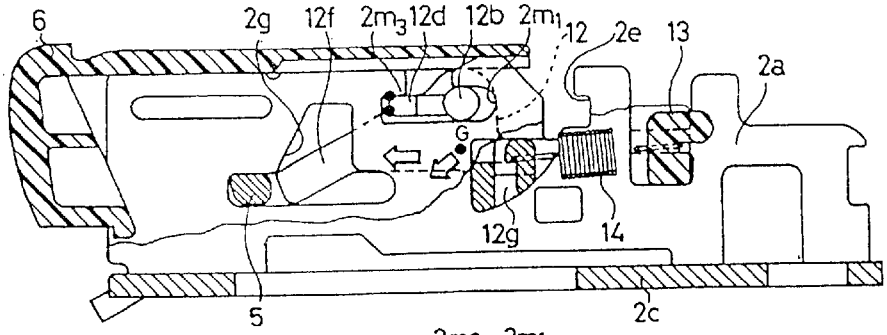
Figure 5D:
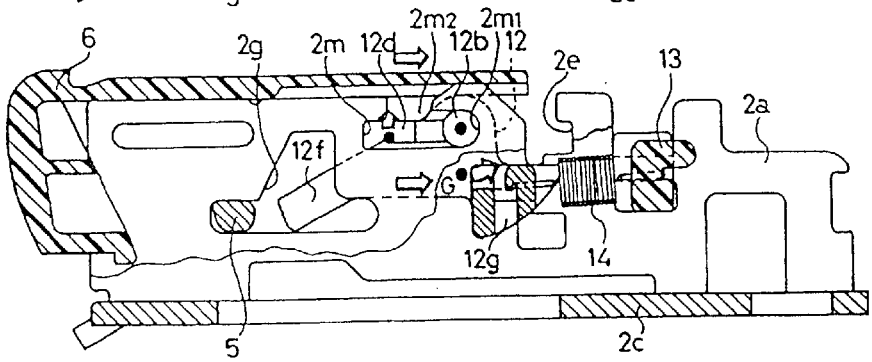

FIG. 1 is an exploded perspective view showing an embodiment of the buckle of the present invention, FIG. 2 is a sectional view showing the buckle of this embodiment in the unlatched state in which a tongue is not engaged, FIG. 3 is a sectional view showing the buckle of this embodiment in the latched state in which the tongue is engaged, and FIG. 4 is a view showing a guide hole, a supporting groove and a guide groove formed in a side wall of a base of the buckle of this embodiment. It is to be noted that the terms "right" and "left" used in the following description represent the right and the left in the drawings.

As shown in FIG. 1 through FIG. 4, the buckle 1 of this embodiment comprises a base 2 which is a U-shaped frame having side walls 2*a,* 2*b* and a bottom 2*c;* a latch member 4 which is pivotally supported by the side walls 2*a,* 2*b* of the base 2 and can engage a tongue 3; a lock pin 5 for preventing the latch member 4 from moving in the unlatching direction when the tongue 3 is engaged by the latch member 4; an operational button 6 disposed to the side walls 2*a,* 2*b* of the base 2 in such a manner that the operational button 6 can move in the longitudinal direction of the base 2; an ejector 7 disposed on the bottom 2*c* of the base 2 in such a manner that the ejector 7 can slide in the longitudinal direction of the base 2 and can urge the tongue in such a direction as to release from the buckle 1; a slider 8 having a lock-pin holding portion 8*a* for holding the lock pin 5; a slider spring 9 which is compressed and disposed between the slider 8 and the latch member 4 and always urges the slider 8 to press the lock pin 5 toward the latch member 4; a button spring 10 always urging the operational button 6; an ejector spring 11 always urging the ejector 7; an inertia lever member 12, i.e. movement preventing means, which is pivotally supported by the side walls 2*a,* 2*b* of the base 2 in such a manner that it can move in the longitudinal direction of the base 2 and which prevents the lock pin 5 from moving due to inertia to a release position where the engagement between the tongue 3 and the latch member 4 is released; a spring holder 13 supported by and fixed to the side walls 2*a,* 2*b* of the base 2; a lever spring 14 which is stretched and disposed between the inertia lever member 12 and the spring holder 13; and an upper cover 15 and a lower cover 16 engaging each other in such a manner that the base 2 on which the aforementioned components are assembled is covered from the top and the bottom.

The side walls 2*a,* 2*b* of the base 2 are provided with supporting grooves 2*d,* 2*e* for supporting shaft portions 4*a,* 4*b* of the latch member 4, inverted T-shaped guide holes 2*f,* 2*g* for supporting and guiding both end portions of the lock pin 5, a spring supporting portion 2i formed in one side wall 2*b* for supporting one end of the button spring 10, guide grooves 2*k,* 2*m* which support shaft portions 12*a,* 12*b* of the inertia lever member 12 in such a manner that the inertia lever member 12 can pivot and move in the longitudinal direction and which receive pressed portions 12*c,* 12*d* for returning the inertia lever member 12 from its operative position to its inoperative position by pressing the operational button 6, receiving portions 2*n,* 2*o* in which mounting portions 13*a,* 13*b* of the spring holder 13 are fitted in such a manner as to allow the removal of the spring holder 13, and guide portions 2*p,* 2*q* for guiding the tongue 3 during the insertion of the tongue 3 into the buckle 1. In addition, the bottom 2*c* of the base 2 is provided with guide rail 2*h* (another one is disposed symmetrically with the guide rail 2*h* relative to the longitudinal to axis, but not shown), in which guide grooves 7*a,* 7*b* of the ejector 7 are slidably fitted and which guide the elector 7 in the longitudinal direction, and a spring supporting portion 2*j* for supporting one end of the ejector spring 11.

The configurations of the supporting groove 2*e,* the inverted T-shaped guide hole 2*g,* and the guide groove 2*m* formed in the side wall 2*b* are shown in FIG. 4. The supporting groove 2*e* has a shaft supporting portion 2*e*1 for pivotally supporting the shaft portion 4*b* of the latch member 4. The inverted T-shaped guide hole 2*g* comprises a longitudinal hole portion 2*g*1 extending in the longitudinal direction and a vertical hole portion 2*g*2 extending upwardly from a middle portion of the longitudinal hole portion 2*g*1. An upper portion of a left end of the longitudinal hole portion 2*g* a lock-pin holding portion 2*g*3 for holding the upper side of the lock pin 5 to prevent the upward movement of the lock pin 5 when the lock pin 5 is in its locked position (shown by a two-dot chain line in FIG. 4). A left end edge of the vertical hole portion 2*g*2 is a guiding portion 2*g*4 for guiding the lock pin 5 when the lock pin 5 moves from the unlocked position (shown by a chain line in FIG. 4) to the locked position or moves vice versa. The guiding portion 2*g*4 is an inclined surface extending upwardly in the right direction from the longitudinal hole portion 2*g*1. The intersection between the lock-pin holding portion 2*g*3 and guiding portion 2*g*4 is a rounded portion 2*g*5 formed in an arc shape, the radius of which is set preferably as small as possible.

The guide groove 2*m* comprises a shaft supporting portion 2*m*1 for supporting the shaft portions 12*b* of the inertia lever member 12, an opening 2*m*2 through which the pressed portion 12*d* of the inertia lever member 12 can pass as shown by a chain line in FIG. 4 when the inertia lever member 12 pivots between the inoperative position and the operative position, and a pivot preventing portion 2*m*3 for preventing the pivotal movement of the inertia lever member 12 into the inoperative position by the contact with the pressed portion 12*d* as shown by a two-dot chain line in FIG. 4 when the inertia lever member 12 moves due to inertia.

Supporting groove 2*d,* guide hole 2*f* and guide groove 2*k* formed in the side wall 2*a* are not shown in FIG. 4, but are formed in the same configurations as the supporting groove 2*e,* the guide hole 2*g* and the guide groove 2*m,* respectively. Though the components of the guide hole 2*f* are not shown in FIG. 4, these are designated as a longitudinal hole portion 2*f*1, a vertical hole portion 2*f*2, a lock-pin holding portion 2*f*3, a guiding portion 2*f*4, and a rounded portion 2*f*5 in the following description.

The latch member 4 comprises a joggle portion 4*c* which can engage the tongue 3, pressed portions 4*d,* 4*e* which can be pressed by an end opposite to the operational end of the operational button 6 to move the latch member 4 in a releasing direction when the tongue 3 and the buckle 1 are disengaged by the operational button 6, and a spring supporting portion 4*f* for supporting one end of the slider spring 9. The latch member 4 takes a non-latched position where the tongue 3 is not engaged by the latch member 4, and a latched position where the tongue 3 is engaged by the latch member 4. The latch member 4 can pivot about the shaft portions 4*a,* 4*b* between the non-latched position and the latched position.

The lock pin 5 is disposed so that the lower end thereof always contacts the top surface of the latch member 4. The lock pin 5 takes the aforementioned locked position, set by the spring force of the slider spring 9, where the lock pin 5 is positioned in the longitudinal hole portions 2*f*1, 2*g*1 of the inverted T-shaped guide holes 2*f,* 2*g*to lock or keep the latched state of the latch member 4 while the latch member 4 engages the tongue 3, and the aforementioned unlocked position, set by the operating force of the operational button 6, where the lock pin 5 is positioned in the vertical hole portions 2*f*2, 2*g*2 of the inverted T-shaped guide holes 2*f,* 2*g*to release the engagement of the latch member 4 from the tongue 3, wherein the unlocked position is located on the right side of the locked position. The lock pin 5 has a section formed in a substantially rectangular shape or a substantially inverse trapezoidal shape having a shorter bottom side. During the movement of the lock pin 5, one corner 5*b* of the lock pin 5 always touches the guiding portions 2*f*4, 2*g*4 or the rounded portions 2*f*5, 2*g*5 of the guide holes 2*f,* 2*g* and the upper surface 5*a* of the lock pin 5 touches the holding portions 2*f*3, 2*g*3. The corner 5*b* is a rounded portion, the radius of which is set preferably as smaller as possible.

The operational button 6 comprises a plane portion 6*a* extending in the longitudinal direction and in the width direction, side walls 6*b* (one side wall is not shown in FIG. 1 and is formed in the same manner as the side wall 6*b*. For convenience of explanation, numeral 6*b* designates both side walls.) formed perpendicularly to the plane portion 6*a* and thus disposed on both side edges of the plane portion 6*a,* and a spring supporting portion 6*c* disposed at a position shifted to one side from the center along the longitudinal direction, for supporting the other end of the button spring 10. In this case, as shown in FIG. 2 and FIG. 3, the plane portion 6*a* and the side walls 6*b* of the operational button 6 form together an inverted U-shaped cross-section and extend to the right side of the shaft portions 12*a,* 12*b* of the inertia lever member 12. Disposed inside the side walls 6*b* of the operational button 6 are inertia lever operating portions, not shown in FIG. 1 through FIG. 3, comprising inclined surfaces which press the pressed portions 12*c,* 12*d* of the inertia lever member 12 in such a manner as to move the inertia lever member 12 from the operative position to the inoperative position (schematically shown in FIG. 4 as an inertia lever operating portion 6*d*). Also disposed inside the side walls 6*b* of the operational button 6 are lock pin operating portions, also not shown in FIG. 1 through FIG. 3, comprising vertical surfaces which press the both end portions of the lock pin 5 to move the lock pin 5 from the locked position to the unlocked position (schematically shown in FIG. 4 as a lock pin operating portion 6*e*).

In this embodiment, as the operational button 6 is operated to move to the right for releasing the state in which the tongue 3 and the buckle 1 are engaged, the inertia lever operating portions 6*d* come in contact with the pressed portions 12*c,* 12*d* of the inertia lever member 12 to press the pressed portions 12*c,* 12*d* toward the inoperative position of the inertia lever member 12, and then, the lock pin operating portions 6*e* come in contact with the lock pin 5 to move the lock pin 5 toward its unlocked position.

The ejector 7 comprises a protrusion 7*c* which is disposed along the longitudinal center thereof and comes in point-contact with the joggle portion 4*c* of the latch member 4, and a spring supporting portion 7*d* for supporting the other end of the ejector spring 11.

The slider 8 comprises a spring supporting portion 8*b* for supporting the other end of the slider spring 9.

The inertia lever member 12 composes a shock-proof system for preventing the movements of the lock pin 5 and the operational button 6 into their release positions due to inertia while the tongue 3 and the buckle 1 are engaged. The inertia lever member 12 comprises levers 12*e,* 12*f,* mass bodies 12*g,* 12*h* which are structured to have center of gravity G substantially perpendicular to the extension direction of the levers 12*e,* 12*f,* and a spring supporting portion 12*i* for supporting one end of the lever spring 14. In this case, the mass of the mass bodies 12*g,* 12*h* is designed in such a manner that the moment about the shaft portions 12*a,* 12*b* produced by the inertia force acting on the center of gravity G of the mass bodies 12*g,* 12*h* due to inertia is larger than the moment around the shaft portions 12*a,* 12*b* produced by the force of the inertia lever operating portions 6*d* for pressing the pressed portions 12*c,* 12*d* of the inertia lever member 12 toward the inoperative position of the inertia lever member 12 due to the inertia movement of the operational button 6 in the releasing direction.

The spring holder 13 comprises a spring supporting portion 13*c* for supporting the other end of the lever spring 14.

Among the aforementioned components, the operational button 6, the ejector 7, the slider 8, the spring holder 13, the upper cover 15, and the lower cover 16 are made of resin and the other components are made of metal.

Though there is no illustration in any of the drawings, a known buckle pretensioner is connected to the base 2 of the buckle 1. The buckle pretensioner is actuated in case of emergency, such as a vehicle collision, to rapidly pull the base 2 to the right in the drawings, whereby the seat belt can quickly restrain a vehicle occupant.

Hereinafter, description will be made as regard to the action of the buckle 1 of this embodiment structured as mentioned above for engaging the tongue 3 and the action of the shock proof system composed of the inertia lever member 12 for preventing the inertia release.

FIGS. 5(*a*)–5(*d*) are views for explaining the action of the buckle of this embodiment for engaging the tongue and the action for preventing the inertia release while the buckle and the tongue are engaged, wherein FIG. 5(*a*) is a view showing the unlatched state in which the tongue is not engaged with the buckle, FIG. 5(*b*) is a view showing the latched state in which the tongue is engaged with the buckle, FIG. 5(*c*) is a view showing the state when the buckle is pulled by the buckle pretensioner, and FIG. 5(*d*) is a view showing the state when the buckle is suddenly stopped at the end of pretensioning movement by the buckle pretensioner. For convenience of explanation, the sections are irregularly shown and illustrations of components not directly related to the following description are partially omitted.

In the unlatched state of the buckle 1 in which the tongue 3 is not engaged, as shown in FIG. 2 and FIG. 5(*a*), the ejector 7 is set in its left-most position by the spring force of the ejector spring 11. In this left-most position of the ejector 7, the ejector 7 presses the joggle portion 4*c* of the latch member 4 so that the bottom 4*c* 1 of the joggle portion 4*c* of the latch member 4 is in point-contact with the protrusion 7*c* formed on the top of the ejector 7. In this state, the latch member 4 is out of the path for the tongue 3, that is, in the unlatched position where it does not engage the tongue 3. At this point, the lock pin 5 is in contact with the upper surface of the latch member 4 and is thus lifted by the latch member 4, so that the lock pin 5 is set at the unlocked position in the vertical hole portions 2*f*2, 2*g*2 of the inverted T-shaped holes 2*f*, 2*g*. In this unlatched state of the buckle 1, since the levers 12*e*, 12*f* of the inertia lever member 12 are mounted on the lock pin 5 and the lock pin 5 is lifted to be located at the unlocked position, the levers 12*e*, 12*f* of the inertia lever member 12 are set in the inoperative position as shown by dotted lines of FIG. 5(*a*). Because of the spring force of the lever spring 14 acting rightward, the inertia lever member 12 is in the state in which the shaft portions 12*a*, 12*b* thereof are in contact with the shaft supporting portions 2*k*1 , 2*m*1 of the guide grooves 2*k*, 2*m*.

As the tongue 3 is inserted into the buckle 1 through a tongue-insertion opening 1a formed in the left end of the buckle 1 in the unlatched state of the buckle 1 shown in FIG. 2 and FIG. 5(*a*), the right end of the tongue 3 abuts against the left end of the ejector 7 and then presses the ejector 7 rightward. Accordingly, the ejector 7 moves to the right so as to compress the ejector spring 11 according to the insertion of the tongue. By the movement of the ejector 7, the joggle portion 4*c* mounted on the protrusion 7*c* of the ejector 7 comes off the ejector 7. Since the lock pin 5 is pressed down by the spring force of the slider spring 9 via the slider 8 and the lock pin 5 presses in turn the joggle portion 4*c* of the latch member 4, the latch member 4 pivots about the shaft portions 4*a*, 4*b* in the counter-clockwise direction in the drawings. Therefore, the joggle portion 4*c* of the latch member 4 enters into the path for the tongue 3 and is inserted into an engaging hole 3*a* of the tongue 3, so that the latch member 4 comes into the latched position. As the operating force for insertion applied to the tongue 3 is stopped, the ejector 7 presses the right end of the tongue 3 by the spring force of the ejector spring 11 whereby the right end portion of the engaging hole 3*a* of the tongue 3 is engaged with the joggle portion 4*c*. As a result of this, the tongue 3 is engaged with the buckle 1, that is, the buckle 1 comes to its latched state as shown in FIG. 3 and FIG. 5(*b*).

During this, the lock pin 5 is guided by the guiding portions 2*f*4, 2*g*4, i.e. the inclined surfaces, to move down in the vertical hole portions 2*f*2, 2*g*2 to enter into the longitudinal hole portions 2*f*1, 2*g*1 and move to the left, i.e. into the locked position. In the locked position of the lock pin 5, since the upper side of the lock pin 5 is held by the lock-pin holding portions 2*f*3, 2*g*3, the upward movement of the lock pin 5 is prevented. Therefore, the lock pin 5 keeps the latch member 4 in the latched position, thereby preventing the latch member 4 from coming off the engaging hole 3*a* of the tongue 3 and thus securely keeping the engagement between the tongue 3 and the buckle 1.

In this latched state of the buckle 1 in which the tongue 3 is engaged, since the spring supporting portion 12*i* of the inertia lever member 12 is pulled by the spring force of the lever spring 14, the inertia lever member 12 pivots about the shaft portions 12*a*, 12*b* supported by the shaft supporting portions 2*k*1 , 2*m*1 in the counter-clockwise direction. As shown in FIG. 5(*b*), therefore, the ends of the levers 12*e*, 12*f* enter into the path of the lock pin 5 for moving to the unlocked position and the pressed portions 12*c*, 12*d* are in such positions capable of passing through the openings 2*k*2, 2*m*2, so that the inertia lever member 12 is in the operative position. In the operative position of the inertia lever member 12, even when the lock pin 5 tends to move to the unlocked position, the lock pin 5 comes in contact with the lever 12*e*, 12*f*, thereby preventing the movement of the lock pin 5 to the unlocked position.

In this manner, the engagement between the tongue 3 and the buckle 1 can be securely conducted and can be securely prevented from releasing.

To release the engagement between the tongue 3 and the buckle 1, as the operational button 6 is pressed to the right, the operational button 6 moves to the right, and as described above, the inertia lever operating portions 6*d* of the operational button 6 press the pressed portions 12*c*, 12*d* of the inertia lever member 12 toward the inoperative position, so that the inertia lever member 12 pivots about the shaft portions 12*a*, 12*b* in the clockwise direction in such a manner that the pressed portions 12*c*, 12*d* pass through the openings 2*k*2, 2*m*2. Accordingly, the ends of the levers 12*e*, 12*f* move upwardly above the path of the lock pin 5 for moving in the longitudinal direction.

As the operational button 6 further moves to the right from this state, the lock pin operating portions 6*e* move the lock pin 5 to the right. When the lock pin 5 arrives such a position to be able to move to the vertical hole portions 2*f*2, 2*g*2, the lock pin 5 is no longer held by the lock-pin holding portions 2*f*3, 2*g*3, so that the latch member 4 is allowed to pivot about the shaft portions 4*a*, 4*b* in the clockwise direction. At this point, the lock pin 5 is positioned just below the levers 12*e*, 12*f*. Since the lock pin 5 is not held by the lock-pin holding portions 2*f*3, 2*g*3 and the ejector 7 is biased in the releasing direction by the spring force of the ejector spring 11, the ejector 7 springily presses the latch member 4, so that the latch member 4 pivots about the shaft portions 4*a*, 4*b* in the clockwise direction. As a result, the joggle portion 4*c* comes off the engaging hole 3*a* of the tongue 3 and the tongue 3 is pushed out to the left. At this point, the lock pin 5 is lifted up by the latch member 4 according to the pivot movement of the latch member 4 in the clockwise direction and thus enter into the vertical hole portions 2*f*2, 2*g*2. In addition, the lock pin 5 presses the levers 12*e*, 12*f*, so that the inertial lever member 12 pivots about the shaft portions 12*a*, 12*b* in the clockwise direction.

Then, the bottom 4*c*1 of the joggle portion 4*c* of the latch member 4 is mounted on the protrusion 7*c* of the ejector 7. Finally, the ejector 7 comes to the left-most position, the latch member 4 comes to the unlatched position, the lock pin 5 comes to the unlocked position, and the inertia lever member 12 comes to the inoperative position, so that the buckle 1 comes to the unlatched state in which the tongue 3 is released as shown in FIG. 2 and FIG. 5(*a*).

Hereinafter, description will be made as regard to the operation of the shock proof system by the inertia lever member 12.

As the buckle pretensioner is actuated in case of emergency, such as a vehicle collision, when the seat belt is worn, i.e. when the buckle 1 is in the latched state in which the tongue 3 is engaged as shown in FIG. 3 and FIG. 5(*b*), the base 2 is suddenly pulled to the right. Consequently, extremely large rightward acceleration is exerted to the buckle 1, that is, the buckle 1 is subjected to large leftward inertia force. At this point, the inertial lever member 12 is allowed to move to the left and to pivot in the clockwise direction. Therefore, while the buckle 1 is pulled by the buckle pretensioner, as shown in FIG. 5(*c*), only the inertia lever member 12 moves to the left due to its inertia force acting on the center of gravity G, whereby the pressed portions 12*c*, 12*d* of the inertia lever member 12 are quickly positioned below the pivot preventing portions 2*k*3, 2*m*3. Though, at this point, the inertia lever member 12 tends to pivot in the counterclockwise direction due to the inertia force acting on the center of gravity G of the mass bodies 12*g*, 12*h*, the ends of the pressed portions 12*c*, 12*d* come in contact with the pivot preventing portions 2*k*3, 2*m*3, whereby the inertia lever member 12 is prevented from pivoting.

At the end of the pretensioning movement by the buckle pretensioner, the buckle is suddenly stopped from this state, so that a large inertia force is exerted to the buckle 1 in a direction opposite to the direction of the inertia force exerted while the buckle 1 is pulled (i.e. in the rightward direction). As shown in FIG. 5(*d*), therefore, the inertia lever member 12 moves to the right, so that the shaft portions 12*a*, 12*b* are returned to be supported by the shaft supporting portions 2*k*1, 2*m*1. In this state, the operational button 6 also moves to the right due to its inertia so that the inertia lever operating portions 6*d* collide with the pressed portions 12*c*, 12*d* to press the pressed portions 12*c*, 12*d* in the diagonally upward direction by the inclined surfaces thereof. The inertia force of the operational button 6 produces a moment for rotating the inertia lever member 12 in the clockwise direction. On the other hand, at the same time, the inertia force acting on the center of gravity G of the mass bodies 12*g*, 12*h* produces a moment for rotating the inertia lever member 12 in the counter-clockwise direction. Since the mass bodies 12*g*, 12*h* are designed in such a manner that the moment in the counter-clockwise direction produced by the inertia force acting on the center of gravity G of the mass bodies 12*g*, 12*h* is larger than the moment in the clockwise direction produced by the inertia force of the operational button 6, the inertia lever member 12 does not pivot, so that the levers 12*e*, 12*f* are prevented, at the end of the pretensioning movement, from coming off the path of the lock pin 5 for moving in the longitudinal direction. Therefore, even when the lock pin 5 tends to move to the right, i.e. into the unlocked position, due to the inertia force at the end of the pretensioning movement, the lock pin 5 comes in contact with the ends of the levers 12*e*, 12*f* and is thereby prevented from moving into the unlocked position. In this manner, the inertia release of the tongue 3 due to the actuation of the buckle pretensioner can be prevented, so that the engagement between the tongue 3 and the buckle 1 can be held securely and strongly.

Though the buckle of this embodiment is connected to the buckle pretensioner, it should be understood that the present invention can be applied to a buckle of a seat belt device without a buckle pretensioner.

As apparent from the above description, in a buckle of the present invention, when a large inertia force is exerted to the buckle, the movement prevention means prevents its pivotal movement in such a direction that the lever thereof comes off the path of the movement of the lock member, thereby securely preventing the inertia release.

In this case, the movement prevention means is composed of only the mass body and the lever, thereby simplifying the structure thereof.

While the invention is explained with reference to the specific embodiments of the invention, the explanation is illustrative and the invention is limited only by the appended claims.

What is claimed is:

1. A buckle comprising:

a base having side walls;

a latch member supported by the side walls to pivot between an unlatched position and a latched position so that when a tongue is inserted to a predetermined position, the latch member pivots to the latched position to engage the tongue;

an operational member for releasing the engagement between the tongue and the latch member;

a lock member attached to the base to be movable between an unlocked position and a locked position, said lock member being set in the locked position to hold the latch member in the latched position when the tongue is engaged with the latch member, and being moved by the operational member to the unlocked position to allow the engagement between the tongue and the latch member to be released; and movement prevention means disposed in the base for preventing the operational member and the lock member from moving into a position to allow the engagement between the tongue and the latch member to be released when the operational member and the lock member are subjected to large inertia force, said movement prevention means comprises a pivot shaft, a mass body having a center of gravity arranged eccentrically relative to the pivot shaft, and a lever for preventing the lock member from moving into the unlocked position, said movement prevention means being disposed between the side walls in such a manner that the movement prevention means is movable in a longitudinal direction of the buckle and pivotable.

2. A buckle according to claim 1, wherein said movement prevention means is arranged in the base such that the lever is out of a path of movement of the lock member when the lock member is set in the unlocked position, and is in the path of movement of the lock member when the lock member is set in the locked position.

3. A buckle according to claim 2, wherein said movement prevention means has a mass such that when an inertia force is exerted in a direction opposite to a direction of releasing the engagement between the tongue and the latch member, the movement prevention means moves in a longitudinal direction so as to prevent a pivotal movement of the movement prevention means due to the inertia force acting on the center of gravity of the mass body; and when the inertia force is exerted in the direction of releasing the engagement between the tongue and the latch member, a moment acting on the movement prevention means in a direction of holding the lever in the path of the lock member is produced by the inertia force acting on the center of gravity of the mass body, and a moment acting on the movement prevention means in a direction moving the lever to come off the path of the lock member is produced by the inertia force of the operational member, said mass body being designed such that the moment produced by the inertia force acting on the center of gravity of the mass body is larger than the moment produced by the inertia force of the operational member.

4. A buckle according to claim 3, further comprising a spring attached to the movement prevention means for pulling the same in a tongue insertion direction.

* * * * *